United States Patent [19]

Kienhofer et al.

[11] 4,127,122

[45] Nov. 28, 1978

[54] BREATHING APPARATUS

[75] Inventors: Manfred Kienhofer, Eggenstein-Leopoldshafen, Fed. Rep. of Germany; Johann Pedrerol, Zurich, Switzerland

[73] Assignee: Gesellschaft für Kernforschung GmbH, Karlsruhe, Fed. Rep. of Germany

[21] Appl. No.: 781,468

[22] Filed: Mar. 25, 1977

[30] Foreign Application Priority Data

Mar. 26, 1976 [DE] Fed. Rep. of Germany ..... 2612877

[51] Int. Cl.[2] ..... A62B 7/00

[52] U.S. Cl. ..... 128/142.5; 128/142.6; 128/142.4; 137/557; 116/70; 116/117 R

[58] Field of Search ..... 128/141 R, 142 R, 142.2, 128/142.3, 142.4, 142.5, 142.6, 142.7, 145 R, 145.6, 147, 139, 191 R, DIG. 17; 137/557; 116/70 R, 112 R, 114 PV, 117 R

[56] References Cited

U.S. PATENT DOCUMENTS

| | | | |
|---|---|---|---|
| 2,573,414 | 10/1951 | Dunn | 128/142.5 |
| 2,828,741 | 4/1958 | Delest | 128/DIG. 17 |
| 3,050,003 | 8/1962 | Edwards | 137/557 X |
| 3,413,972 | 12/1968 | Depping | 128/142.7 |
| 3,536,071 | 10/1970 | Ferrando | 128/142.4 |
| 3,739,774 | 6/1973 | Gregory | 128/142.3 X |

FOREIGN PATENT DOCUMENTS

| | | | |
|---|---|---|---|
| 782,137 | 3/1935 | France | 128/142.6 |

*Primary Examiner*—Henry J. Recla
*Attorney, Agent, or Firm*—Spencer & Kaye

[57] ABSTRACT

A breathing apparatus for supplying air to a helmet and/or protective clothing comprises a base plate; a core body secured to the base plate; an air driving device supported by the core body; an air inlet and an air outlet for the air driving device; an energy source secured to the base plate and connected to the air driving device for operating the same; an aerating hose coupled to the air outlet; and an air filter connected to the air inlet for filtering air driven through the air inlet, the air outlet and the aerating hose by the air driving device.

18 Claims, 2 Drawing Figures

BREATHING APPARATUS

BACKGROUND OF THE INVENTION

This invention relates to a breathing apparatus for supplying ventilating air to helmets or protective clothings.

Breathing apparatuses are known wherein a helmet, a mask or a protective clothing is connected by means of hoses with an air compressor or the like. It is further generally known to use masks with mask filters as breathing air protectors which are independent from air supply aggregates and which may find application by firemen or personnel entering toxic rooms or rooms contaminated with radioactive aerosols.

SUMMARY OF THE INVENTION

It is an object of the invention to provide an improved portable self-contained breathing apparatus for helmets and the protection of the upper body in lieu of gas masks or for supplying air to protective clothing for the entire body with the greatest possible operational safety.

This object and others to become apparent as the specification progresses, are accomplished by the invention, according to which, briefly stated, the breathing apparatus for supplying air to a helmet and/or protective clothing comprises a base plate; a core body secured to the base plate; an air driving device supported by the core body; an air inlet and an air outlet for the air driving device; an energy source secured to the base plate and connected to the air driving device for operating the same; an aerating hose coupled to the air outlet; and an air filter connected to the air inlet for filtering air driven through the air inlet, the air outlet and the aerating hose by the air driving device.

According to a further safety feature of the invention, the core body is of elongated shape and has a cavity in which there are serially arranged two breathing air driving devices, such as fans, and further, the air inlet for the cavity is divided into two branches, each connected to a separate filter device which communicates with ambient air. In the cavity, in the flow path of air between, in front of or behind the fans, there is provided a flow-responsive valve arrangement.

Also for safety reasons, according to the invention each fan has its own energy source, for example, a storage battery.

According to a preferred embodiment of the invention, the carrier plate can be secured to the body of a person by means of straps. Further, at least one aerating hose may be divided into air supply branches for the hand portions and foot portions of the protective clothing.

As an additional safety measure, the invention provides that one of the breathing air inlets is connectable through a check valve with a mouthpiece for emergency breathing and further, the valve seat or valve disc of the valve in the cavity of the core body is connected with a warning buzzer.

The breathing apparatus designed according to the invention is of particularly compact and flat construction and has small weight. By using standard mask filters as filter media which are not arranged in the dust area on the front but on the back of the person and, by arranging the apparatus under the clothing to thus protect it from contamination, the apparatus may find substantially universal application. The safety of its operation is further increased by the provision of buzzer-equipped flow monitors (air quantity warning device) and an emergency breathing arrangement for use in case the apparatus malfunctions. The apparatus further permits substantial mobility of personnel, it has a long life expectancy and constitutes no resistance to the intake of air. The field of vision is not impaired whether the helmet or the protective clothing is worn. A particular advantage of the contamination-protected apparatus resides in that an overpressure may be generated in the clothing. It further makes possible to dispense with expensive gas masks and permits the use of inexpensive throw-away helmets.

DESCRIPTION OF THE PREFERRED EMBODIMENTS

Figure 1:
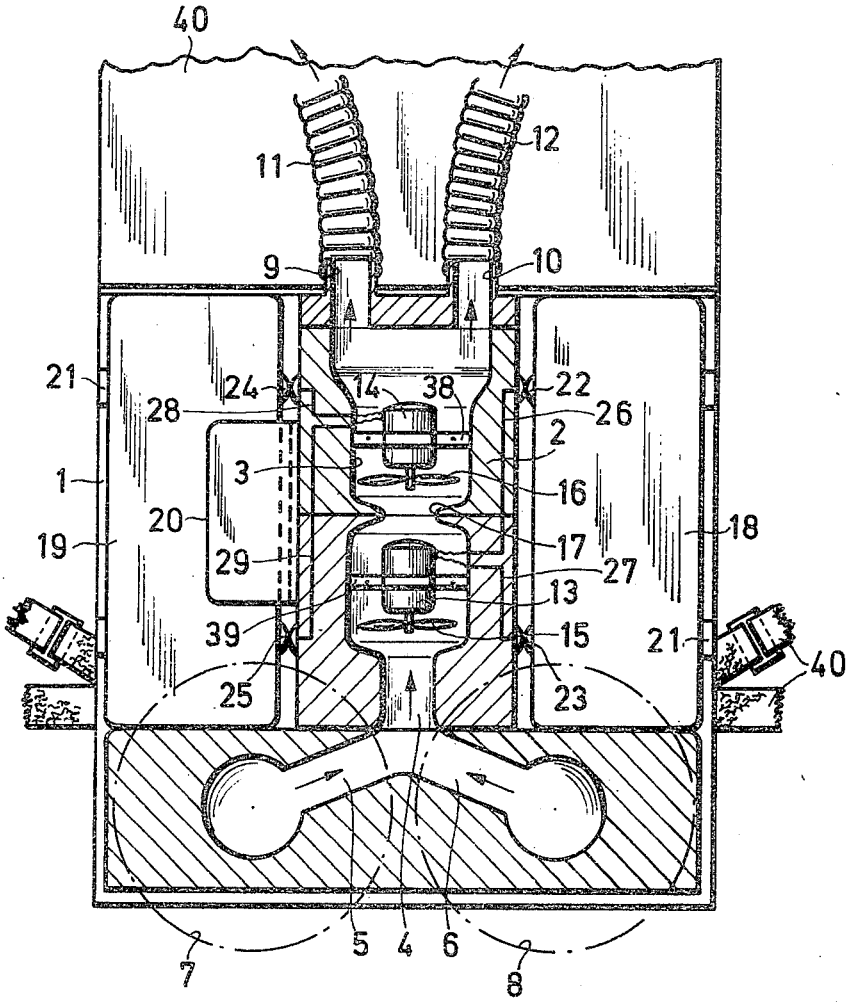
FIGS. 1 and 2 are longitudinal sectional views of two preferred embodiments of the invention.

Turning now to FIG. 1, there is shown a carrier plate 1 of substantially square shape, on which there is medially arranged a multi-part core body 2. The core body is made of a synthetic material and has an axially arranged throughgoing inner cavity 3 which, similarly to the core body 2, has an elongated configuration. One open end of the cavity 3 is connected with a breathing air inlet 4 which, for safety reasons, is divided into two ports 5 and 6 which are provided with filters, such as conventional mask filters 7 and 8 through which, as will be described below, environmental air is drawn into the apparatus. The upper open end of the cavity 3 has, again for safety reasons, two coupling nipples 9 and 10 to which there are attached two breathing or aerating hoses 11 and 12 in an airtight manner. The aerating hoses 11 and 12 lead to a helmet, not illustrated.

In the cavity 3 there are serially arranged two fans 13 and 14; they are secured to the inner wall of the cavity 3 by respective brackets 38 and 39. The impellers 15 and 16 of the respective fans 13 and 14 are oriented in such a manner that they draw breathing air through the filters 7 and 8, that is, they overcome the air resistance of the filters 7 and 8 and drive air through the hoses 11 and 12.

Between the two fans 13 and 14 the cavity 3 has a constriction 17 which, as will be explained in more detail in connection with FIG. 2, can be closed by a valve.

The two fans 13 and 14 are driven by respective storage batteries 18 and 19 which are, similarly to the core body 2, secured to the carrier plate 1. The securing arrangement comprises a clamping plate 20 (which is shown only for the battery 19) which is directly arranged both on the core body 2 and the carrier plate 1 and cams 21. The electric contacts 22, 23 and 24, 25 of the two storage batteries 18 and 19, respectively, are connected by electric conductors 26, 27 and 28, 29 to the fans 13 and 14, respectively.

The carrier plate 1, with the core body 2 and the storage batteries 18 and 19 supported thereby, is attachable by means of carrier straps 40 to either the back or the breast of a person. The entire apparatus may be carried externally of the clothing if the air supply is intended for helmets or masks; it can be worn underneath the protective clothing, in which case between the mask filters 7 and 8 and the inlets 5 and 6 of the core body 2 an airtight connection must be provided between the protective clothing and the core body 2.

Figure 2:
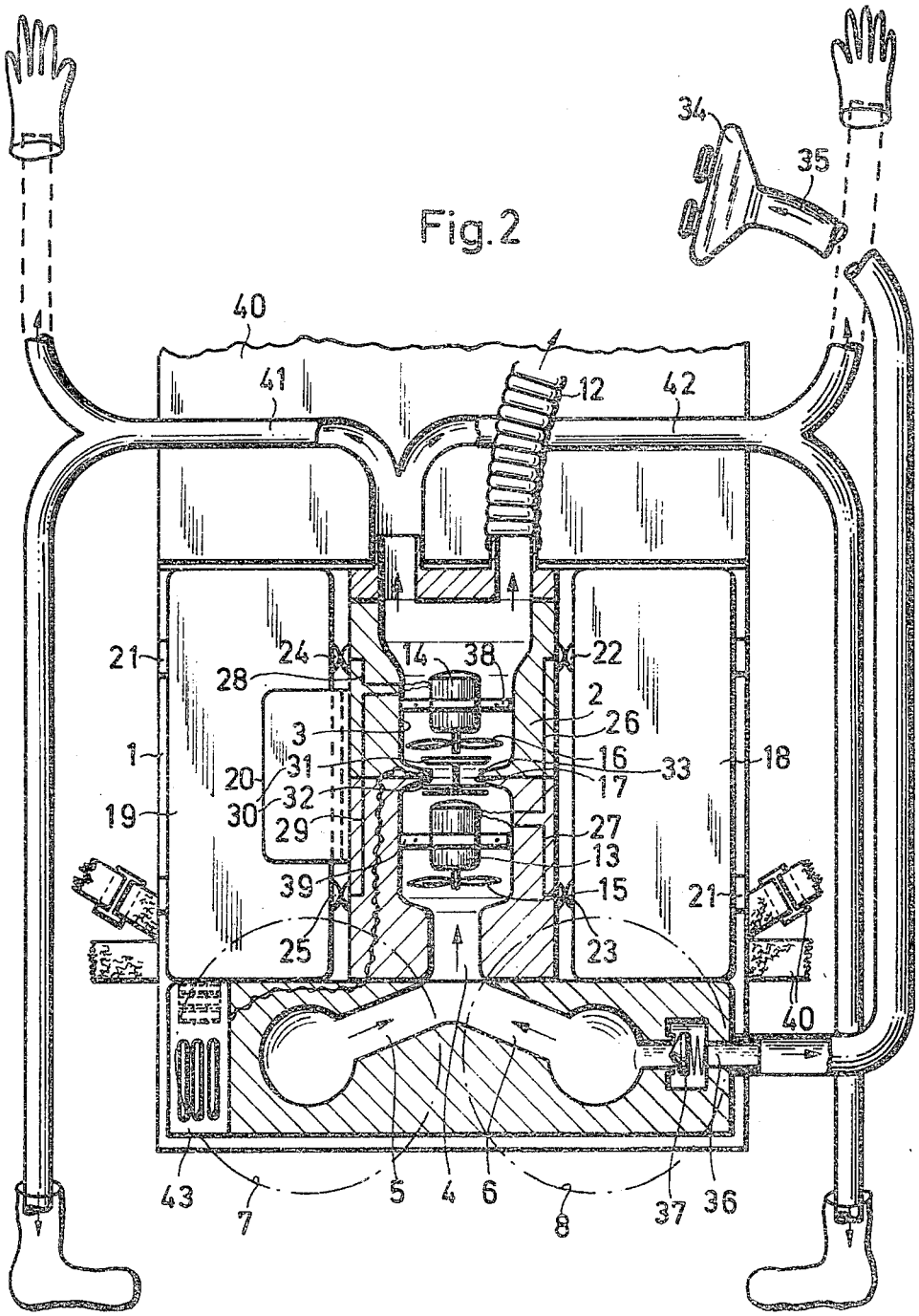

Turning now to FIG. 2, there is shown another preferred embodiment of a breathing apparatus which is similar to FIG. 1, but which has additional safety arrangements. Thus, at the constriction 17 of the cavity 3 there is provided a check valve 30 which, in the simplest embodiment, may be formed of a valve disc 31 and a valve seat 32, the latter being constituted by the constriction 17. The valve 30 is connected through electric contacts 33 with a warning buzzer 43 which may be secured to the carrier plate 1. The valve disc 31 is urged against its seat into a closed position by gravity and/or by a spring, not shown. In the closed position the valve disc 31 closes the buzzer circuit. During normal fan operation, the valve disc 31 is maintained open by the air stream driven by the fans. The check valve 30 will close and sound the warning buzzer 43 when the pressure of the air stream driven by the fans 13 and 14 or the air stream itself drops. This may occur when one of the fans 13 and 14 breaks down. In order to ensure that the respiration of the person is not adversely affected even upon such an occurrence, there is provided, as an additional safety measure, a mouthpiece 34 which leads through a hose 35 to a port 36 which is connected with the port 6 of the air intake by means of a check valve 37. The check valve 37 is normally in a closed position and permits flow of air through the hose 35 solely in the direction of the mouthpiece 34. Thus, breathing may continue through the apparatus via the mouthpiece 34 on an emergency basis, with the circumvention of the malfunctioning fans. The closed check valve 30 ensures that communication between the hose 12 and hose 35 through the apparatus is blocked.

As a further deviation from the first embodiment illustrated in FIG. 1, in the structure of FIG. 2 one of the aerating hoses (hose 11 in FIG. 1) is divided into several branch hoses 41 and 42 which are again branched off to the hand portions and foot portions of the protective clothing for generating therein an overpressure. In such a case it is the hose 12 which alone serves for supplying air to the helmet.

It will be understood that the above description of the present invention is susceptible to various modifications, changes and adaptations, and the same are intended to be comprehended within the meaning and range of equivalents of the appended claims.

What is claimed is:

1. A breathing apparatus for supplying air to a helmet and/or protective clothing, comprising (a) a baseplate;
(b) an elongated core body;
(c) means securing said core body to said baseplate;
(d) means defining in said core body a longitudinally throughgoing cavity;
(e) air driving means supported in said cavity;
(f) means defining in said cavity an air inlet and an air outlet for said air driving means;
(g) energy source means connected to said air driving means for operating the same;
(h) means securing said energy source means to said baseplate;
(i) aerating hose means coupled to said air outlet for supplying air to said helmet and/or said protective clothing;
(j) means defining two ports each having an end communicating with said air inlet;
(k) at least two separate air filters connected to the one and the other of said ports for filtering ambient air drawn through said ports by said air driving means;
(l) a mouthpiece;
(m) means defining a flow passage connecting said mouthpiece with one of said ports to provide for emergency respiration with the circumvention of said cavity; and
(n) a check valve disposed in said flow passage to permit air flow through said passage solely in the direction of said mouthpiece.

2. A breathing apparatus as defined in claim 1, further comprising straps attached to said carrier plate for securing the breathing apparatus to the body of a person.

3. A breathing apparatus as defined in claim 1, wherein said aerating hose means includes branch hoses for communicating with hand portions and foot portions of a protective clothing.

4. A breathing apparatus as defined in claim 1, wherein said air filter means comprises at least one gas mask filter.

5. A breathing apparatus as defined in claim 1, wherein said air driving means is formed of two serially-arranged air driving devices supported in said cavity and wherein said energy source means includes a separate storage battery associated with the one and the other air driving device.

6. A breathing apparatus as defined in claim 1, wherein said air driving means is formed of two serially-arranged air driving devices supported in said cavity.

7. A breathing apparatus as defined in claim 6, wherein said air driving devices are fans.

8. A breathing apparatus for supplying air to a helmet and/or protective clothing, comprising (a) a baseplate;
(b) an elongated core body;
(c) means securing said core body to said baseplate;
(d) means defining in said core body a longitudinally throughgoing cavity;
(e) air driving means supported in said cavity;
(f) means defining in said cavity an air inlet and an air outlet for said air driving means;
(g) energy source means connected to said air driving means for operating the same;
(h) means securing said energy source means to said baseplate;
(i) aerating hose means coupled to said air outlet for supplying air to said helmet and/or said protective clothing;
(j) air filter means connected to said air inlet for filtering air driven through said air inlet, said air outlet and said aerating hose means by said air driving means;
(k) a valve disposed in said cavity in the path of the air flow generated by said air driving means; said valve having
  (1) a valve seat constituted by a constriction formed in said cavity and
  (2) a movable valve member cooperating with said constriction and displaceable from a closed position in the direction of said air flow into an open position; said movable valve member being maintained in its open position by said air flow during normal operation;
(l) signalling means connected to said valve; and
(m) means actuating said signalling means when said valve assumes its said closed position.

9. A breathing apparatus as defined in claim 8, wherein said signalling means includes a warning buzzer.

10. A breathing apparatus as defined in claim 8, wherein said air driving means is formed of two serially-arranged air driving devices supported in said cavity and wherein said constriction is situated between said two air driving devices.

11. A breathing apparatus as defined in claim 8, said movable valve member is a valve disc.

12. A breathing apparatus as defined in claim 8, further comprising straps attached to said carrier plate for securing the breathing apparatus to the body of a person.

13. A breathing apparatus as defined in claim 8, wherein said aerating hose means includes branch hoses for communicating with hand portions and foot portions of a protective clothing.

14. A breathing apparatus as defined in claim 8, wherein said air filter means comprises at least one gas mask filter.

15. A breathing apparatus as defined in claim 8, wherein said air driving means is formed of two serially-arranged air driving devices supported in said cavity and wherein said energy source means includes a separate storage battery associated with the one and the other air driving device.

16. A breathing apparatus as defined in claim 8, wherein said air driving means is formed of two serially-arranged air driving devices supported in said cavity.

17. A breathing apparatus as defined in claim 16, wherein said air driving devices are fans.

18. A breathing apparatus as defined in claim 8, further comprising (n) a mouthpiece;

(o) means defining a flow passage connecting said mouthpiece with one of said ports to provide for emergency respiration with the circumvention of said cavity; and (p) a check valve disposed in said flow passage to permit air flow through said passage solely in the direction of said mouthpiece.

* * * * *